US005167045A

United States Patent [19]

Rodriguez

[11] Patent Number: 5,167,045

[45] Date of Patent: Dec. 1, 1992

[54] DEVICE FOR FACILITATING CLEANING A DRY MOP HEAD

[76] Inventor: Osualdo Rodriguez, 45-32 164th St., Flushing, N.Y. 11358

[21] Appl. No.: 788,413

[22] Filed: Nov. 6, 1991

[51] Int. Cl.[5] ..... A47L 13/20; A47L 13/50

[52] U.S. Cl. ..... 15/228; 15/268; 15/DIG. 9

[58] Field of Search ..... 15/268, 257 R, 257 A, 15/DIG. 9, 209 D, 228, 147 B, 229.3, 310, 300.1, 209 R, 210 R, 176.3; 148/110-111, 143.4

[56] References Cited

U.S. PATENT DOCUMENTS

| | | | |
|---|---|---|---|
| 1,276,470 | 8/1918 | Wilson | 15/268 |
| 2,090,283 | 8/1937 | Carle, Jr. | 15/268 |
| 2,602,395 | 7/1952 | Davis | 15/268 |
| 2,864,105 | 12/1958 | Rose | 15/268 |
| 2,961,681 | 11/1960 | Terzian | 15/209 R |
| 3,991,431 | 11/1976 | Thielen | 15/228 |
| 4,733,424 | 3/1988 | Gurkin | 15/268 |
| 4,886,297 | 12/1989 | Levine | 16/114 R |

*Primary Examiner*—Philip R. Coe
*Assistant Examiner*—Tony G. Soohoo
*Attorney, Agent, or Firm*—Richard L. Miller

[57] ABSTRACT

A device is provided for facilitating cleaning a dry mop head which consists of a dry mop assembly with a removable dry mop head and an interlocking holding member which will grip the dry mop head in an inverted stationary position, so that a person using a vacuum cleaner can clean the dry mop head.

1 Claim, 1 Drawing Sheet

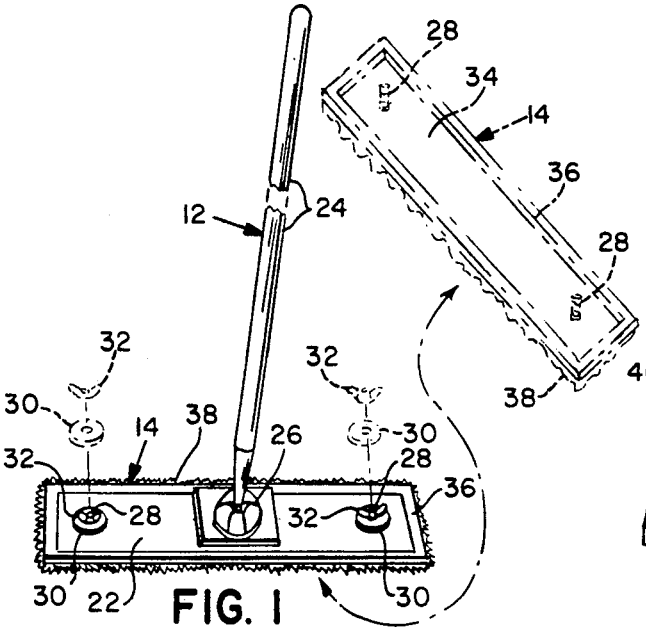
FIG. 1
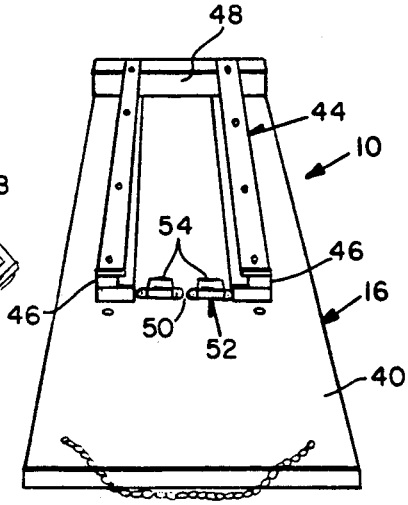
FIG. 2
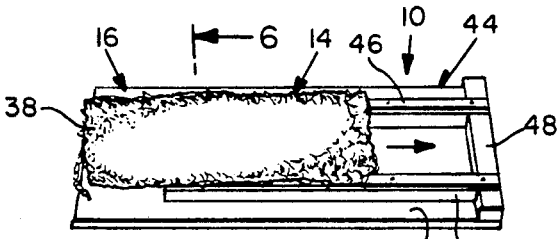
FIG. 3
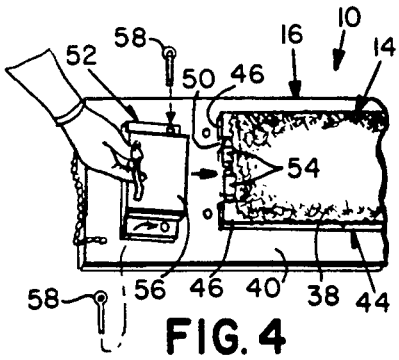
FIG. 4
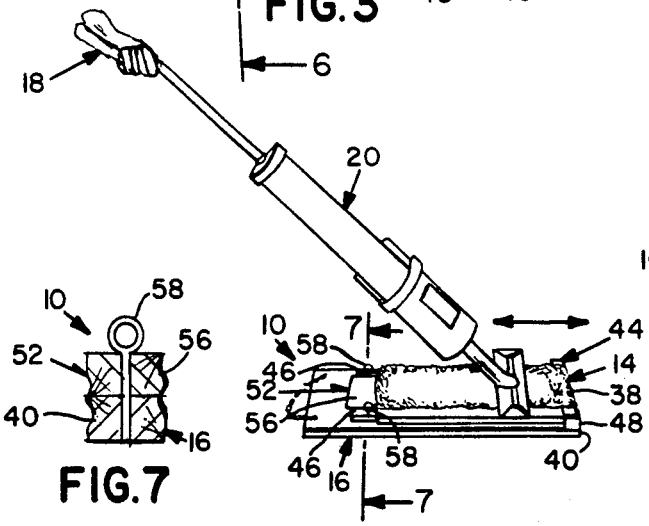
FIG. 5
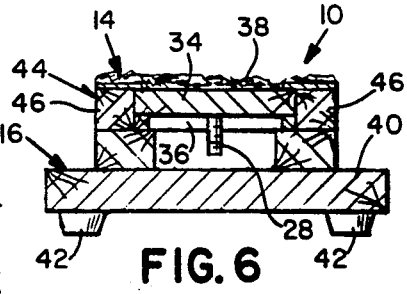
FIG. 6
FIG. 7

DEVICE FOR FACILITATING CLEANING A DRY MOP HEAD

BACKGROUND OF THE INVENTION

The instant invention relates generally to dry mops and more specifically it relates to a device for facilitating cleaning a dry mop head.

Numerous dry mops have been provided in the prior art that are adapted to be mounted to handles so that the dry mops can dust off surfaces without the use of water. For example, U.S. Pat. Nos. 3,449,784 to Moss; 3,453,677 to Cutler and 3,978,541 to Gustafsson all are illustrative of such prior art. While these units may be suitable for the particular purpose to which they address, they would not be as suitable for the purpose of the present invention as hereafter described.

SUMMARY OF THE INVENTION

A primary object of the present invention is to provide a device for facilitating cleaning a dry mop head that will overcome the shortcomings of the prior art devices.

Another object is to provide a device for facilitating cleaning a dry mop head, which will hold an inverted dry mop head in a stationary position, so that the looped yarn of the dry mop head can be cleaned by a person using a vacuum cleaner.

An additional object is to provide a device for facilitate cleaning a dry mop head, that will hold the inverted mop head in an interlocking holding member by a quick release magnetic stopper at one side of a retaining track structure.

A further object is to provide a device for facilitating cleaning a dry mop head that is simple and easy to use.

A still further object is to provide a device for facilitating cleaning a dry mop head that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of a dry mop assembly with a removable dry mop head;

FIG. 2 is an end perspective view of the interlocking holding member of the instant invention;

FIG. 3 is a side perspective view showing the dry mop head being positioned on the interlocking holding member;

FIG. 4 is a top perspective view with parts broken away showing a magnet stopper being attached to the interlocking holding member;

FIG. 5 is a side perspective view illustrating a vacuum cleaner being used to clean the dry mop head that is retained in the interlocking holding member;

FIG. 6 is a diagrammatic cross sectional view taken on line 6—6 in FIG. 3; and FIG. 7 is a cross sectional view, with parts broken away, taken on line 7—7 of FIG. 5, showing a retainer pin in greater detail.

DETAILED DESCRIPTION OF THE PREFERRED EMBODIMENTS

Turning now descriptively to the drawings, in which similar reference characters denote similar elements throughout the several views, the Figures illustrate a device 10 for facilitating cleaning a dry mop head which consists of a dry mop assembly 12 with a removable dry mop head 14 and an interlocking holding member 16 which will grip the dry mop head 14 in an inverted stationary position, so that a person 18 using a vacuum cleaner 20 can clean the dry mop head 14.

The dry mop assembly 12 includes a rectangular flat brace member 22 and an elongated handle 24 pivotally connected at 26 to the center of the brace member 22. Bolts 28, washers 30 and wing nuts 32 are for removably attaching the brace member 22 to the back of the dry mop head 14.

The dry mop head 14 includes a rectangular flat plate 34 and a rectangular frame member 36 affixed to one side of the flat plate 34. The brace member 22 can fit into the frame member 36 against the flat plate 34 to be retained by the bolts 28, washers 30 and wing nuts 32. A loop yarn fabric 38 is affixed to an opposite side of the flat plate 34.

The interlocking holding member 16 includes a rectangular base 40 and a plurality of non-skid feet 42 mounted to the underside of the base 40. A retaining track structure 44 is mounted to the top side of the base 40. The retaining tract structure 44 has a pair of spaced apart elongated side tracks 46, a closed end plate 48 and an opened end 50. The inverted mop head 14 can be inserted within the opened end 50 of the side tracks 46 to butt against the closed end plate 48. A mechanism 52 is for blocking the opened end 50 of the retaining track structure 44 after the inverted mop head 14 is inserted therein.

The blocking mechanism 52 includes a pair of magnets 54 mounted to the base 40 in the opened end 50, between the side tracks 46 of the retaining track structure 44. A magnetic stopper 56 can be removably placed against the magnets 54 and the inverted mop head 14. A pair of retainer pins 58 are also provided to be inserted through the magnetic stopper 56 and the base 40 after the magnetic stopper 56 is placed against the magnets 54 and the inverted mop head 14 to better hold the magnetic stopper against the inverted mop head 14.

To use the device 10, the person 18 simply places the base 40 of the interlocking holding member 16 onto a floor, so that the non-skid feet 42 elevate the base 40 slightly from the floor. The dry mop head 14 is then removed from the dry mop assembly 12, inverted and placed into the retaining track structure 44. The magnetic stopper 56 is then put in place and held with the retainer pins 58. The person 18 can now clean the dry mop head 14 with the vacuum cleaner 20.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A device for facilitating cleaning a dry mop head which comprises:

A) a dry mop assembly with a removable dry mop head, wherein said dry mop assembly includes:

i) a rectangular flat base member;

ii) an elongated handle pivotally connected to the center of said base member; and iii) means for removably attaching said base member to the back of said dry mop head, and wherein said dry mop head includes:

iv) a rectangular flat plate;

v) a rectangular frame member affixed to one side of said flat plate, so that said base member can fit into said frame member against said flat plate to be retained by said removably attaching means; and vi) a loop yarn fabric affixed to an opposite side of said flat plate; and B) an interlocking holding member which will grip said dry mop head, when said dry mop head has been separated from said dry mop assembly, in an inverted stationary position, so that a person using a vacuum cleaner can clean said dry mop head, wherein said interlocking holding member includes:

i) a rectangular base;

ii) a plurality of non-skid feet mounted to the underside of said base;

iii) a retaining track structure mounted to the top side of said base, said retaining track structure having a pair of spaced apart elongated side tracks, a closed end plate and an open end, so that said inverted mop head can be inserted within the opened end of said side tracks to butt against said closed end plate; and iv) means for blocking the opened end of said retaining track structure after said inverted mop head is inserted therein so as to prevent inadvertent removal of said mop head, and wherein said blocking means includes:

a) a pair of magnets mounted to said base in the opened end between said side tracks of said retaining track structure;

b) a magnetic stopper to be removably placed against said magnets and said inverted mop head; and c) a pair of retainer pins to be inserted through said magnetic stopper and said base after said magnetic stopper is placed against magnets and said inverted mop head to better hold said magnetic stopper against said inverted mop head.

* * * * *